US008126178B2

(12) United States Patent
Schmidt et al.

(10) Patent No.: US 8,126,178 B2
(45) Date of Patent: Feb. 28, 2012

(54) IN-THE-EAR HEARING DEVICE WITH A MOVEABLE GRIPPING ELEMENT

(75) Inventors: Benjamin Schmidt, Nürnberg (DE); Erwin Singer, Eckental (DE); Roland Weigert, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 465 days.

(21) Appl. No.: 12/322,981

(22) Filed: Feb. 10, 2009

(65) Prior Publication Data

US 2009/0208046 A1 Aug. 20, 2009

(30) Foreign Application Priority Data

Feb. 15, 2008 (DE) ..... 10 2008 009 186

(51) Int. Cl.
*H04R 25/00* (2006.01)

(52) U.S. Cl. ..... 381/323; 381/329

(58) Field of Classification Search ..... 381/323, 381/328, 329, 324, 330; 429/96, 97, 100
See application file for complete search history.

(56) References Cited

U.S. PATENT DOCUMENTS

| | | | | |
|---|---|---|---|---|
| 4,565,904 | A * | 1/1986 | Harada | 381/329 |
| 4,803,458 | A * | 2/1989 | Trine et al. | 338/198 |
| 5,210,804 | A * | 5/1993 | Schmid | 381/323 |
| 5,712,919 | A | 1/1998 | Ruhling | |
| 5,717,771 | A | 2/1998 | Sauer et al. | |
| 5,784,470 | A * | 7/1998 | Fackler et al. | 381/328 |
| 6,985,598 | B1 * | 1/2006 | Joschika | 381/323 |
| 7,305,101 | B2 * | 12/2007 | Doudoukjian | 381/322 |
| 2005/0232453 | A1 * | 10/2005 | Fideler | 381/322 |

FOREIGN PATENT DOCUMENTS

| | | | |
|---|---|---|---|
| DE | 4215711 | A1 | 12/1992 |
| WO | 91/04644 | A1 | 4/1991 |
| WO | WO 0052964 | A2 | 9/2000 |

* cited by examiner

*Primary Examiner* — Allan R Wilson

(57) ABSTRACT

A smaller and more reliable rechargeable in-the-ear (ITE) hearing device is provided. The ITE hearing device includes a housing, which has a housing surface which points outwards in the worn state, an accumulator in the housing, at least one charging contact for charging the accumulator and a gripping element, which is arranged on the housing surface. The gripping element can be moved from a non-operational position into an operational position. The charging contact is concealed by the gripping element or the housing when the gripping element is in the non-operational position and is not concealed when the gripping element is in the operational position. As a result of the charging contact being concealable, the hearing device's reliability is improved. If the charging contact is fastened to the gripping element, the gripping element achieves an additional functionality resulting in a smaller design overall.

19 Claims, 2 Drawing Sheets

IN-THE-EAR HEARING DEVICE WITH A MOVEABLE GRIPPING ELEMENT

CROSS REFERENCE TO RELATED APPLICATIONS

This application claims priority of German application No. 10 2008 009 186.3 DE filed Feb. 15, 2008, which is incorporated by reference herein in its entirety.

FIELD OF INVENTION

The present invention relates to an in-the-ear hearing device comprising a housing, which has a housing surface, which points outwards when the in-the-ear hearing device is being worn, an accumulator in the housing, at least one charging contact for charging the accumulator and a gripping element which is arranged on the housing surface.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

SUMMARY OF INVENTION

ITE hearing devices with a battery generally have a pivotable battery charger for changing the battery. The battery charger can be advantageously embodied such that it is used at the same time as a gripping element for removing the ITE hearing device from the auditory canal. No battery charger is provided in the case of rechargeable hearing devices, since the accumulator remains continuously in the ITE hearing device. An auxiliary device, for instance a gripping element, is thus needed on the exterior of the hearing device, generally on the faceplate, in order to remove the ITE hearing device.

The rechargeable ITE hearing device, if it is not to be inductively charged, also requires galvanic contacts on the surface. The contacts are advantageously arranged in the faceplate, so that when the ITE hearing device is being worn, it does not come into contact with the skin. However, if they are provided in the faceplate, they also require certain instructions, namely that they are de-energized when the hearing device is in use. This involves numerous complicated electrical or mechanical solutions.

In addition to battery chargers, removal threads and tabs are also known for withdrawing the ITE hearing devices. The removal threads and tabs are only used for the purpose of withdrawing the ITE hearing device from the ear.

The object of the present invention consists in proposing a rechargeable ITE hearing device, which can be of a smaller design and with which a charging contact is protected against unintentional contacting.

This object is achieved in accordance with the invention by an in-the-ear hearing device comprising a housing, which has a housing surface, which points outwards when the in-the-ear hearing device is being worn, an accumulator in the housing, at least one charging contact for charging the accumulator and a gripping element, which is arranged on the housing surface, with the gripping element being moveable from a non-operational position into an operational position and the charging contact in the non-operational position of the gripping element being concealed by the gripping element or the housing and not being concealed thereby when the gripping element is in the operational position.

The gripping element advantageously achieves the additional function of directly or indirectly concealing the charging contact in the non-operational position of the gripping element. This multifunctionality may dispense with the need for additional means for protecting and/or concealing the contact.

The housing surface which points outwards preferably forms part of a faceplate, to which the gripping element is also fastened in a moveable fashion. The faceplate including the gripping element can thus also be produced as a standard component.

It is particularly preferred if the at least one charging contact is arranged on the gripping element. In this way the gripping element achieves the additional function of transmitting the charging current. In particular, the gripping element can be embodied as a connector. A hearing device system can thus be realized with an ITE hearing device and a charging device of this type, with the gripping element with the charging contact illustrating a charging plug, which can be inserted into a corresponding charging socket in the charging device in order to charge the ITE hearing device. The corresponding charging device can thus also be embodied in a relatively simple fashion, since only one suitable socket is to be provided.

The housing surface of the ITE hearing device may also comprise an opening, which is sealed by a sealing plug attached to the gripping element when said gripping element is in the non-operational position. If necessary, the hearing device can be ventilated through the opening and the function of opening and closing the opening is also assigned in this case to the gripping element.

In a special embodiment, the gripping element can be pivoted or linearly pulled between the operational position and the non-operational position. In both cases, the hearing device wearer can therefore introduce the gripping element into the operational position by a simple movement.

The gripping element can also be embodied in the manner of a tab. With this design of the gripping element, the ITE hearing device can generally be effectively gripped and removed from the ear.

The gripping element can also be coupled to a switch such that the ITE hearing device is switched off when the gripping element is in the non-operational position and is switched on when the gripping element is in the operational position. The gripping element thus also achieves the function of a control lever.

The gripping element can also be coupled to a pushbutton such that a pulse can be generated by moving the gripping element. This also allows the gripping element to be used for instance as a programming button for selecting a desired hearing device program.

BRIEF DESCRIPTION OF THE DRAWINGS

The present invention is now described in more detail with reference to the appended drawings, in which.

DETAILED DESCRIPTION OF INVENTION

The exemplary embodiments illustrated in more detail below represent preferred embodiments of the present invention.

Figure 1:
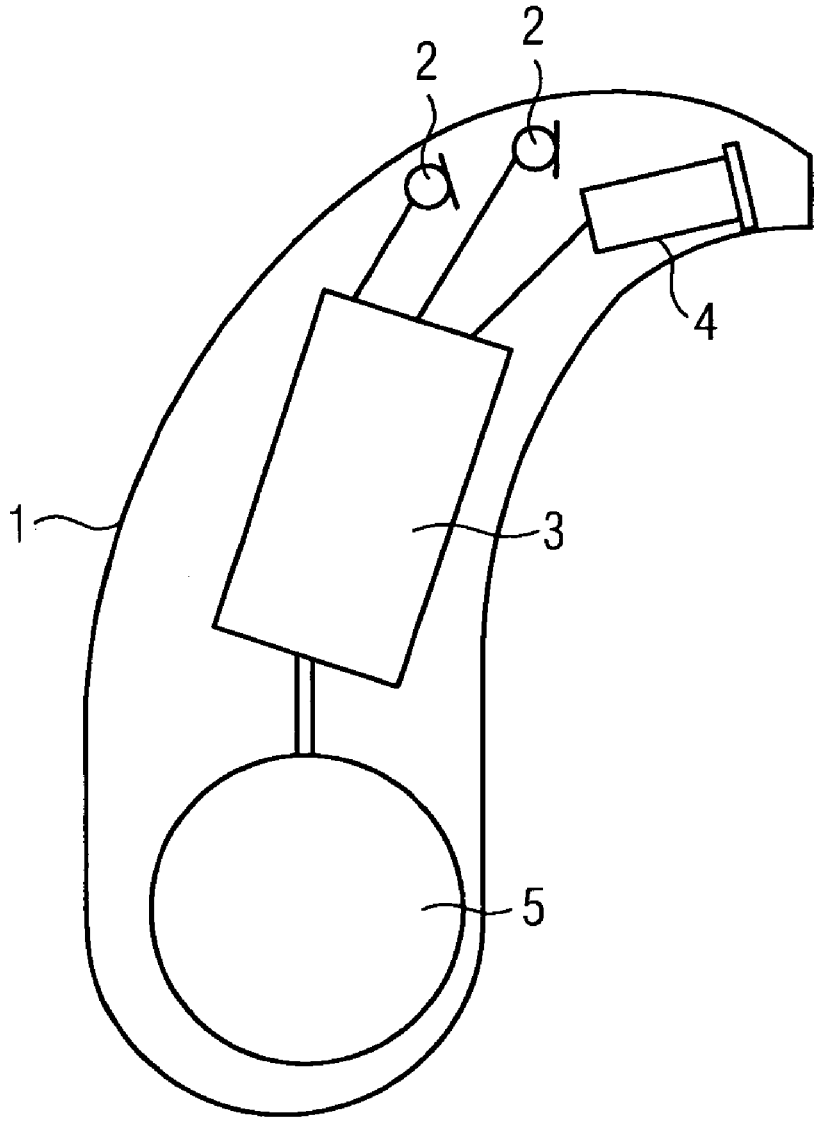
FIG 1 (Prior art)
FIG. 1 shows the diagram of a hearing device with its essential components according to the prior art.
Figure 2:
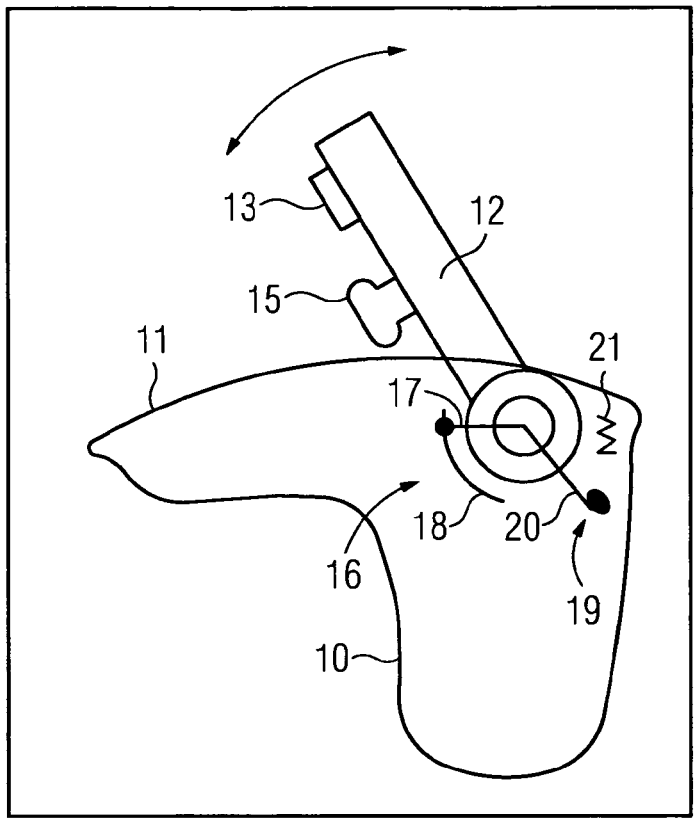
FIG. 2 shows a view of an inventive ITE hearing device.

The ITE hearing device shown in FIG. 2 has an individually manufactured shell 10 and a faceplate 11 adhered thereto. A tab 12 is rotatably mounted on the faceplate 11 as a gripping element.

Figure 3:
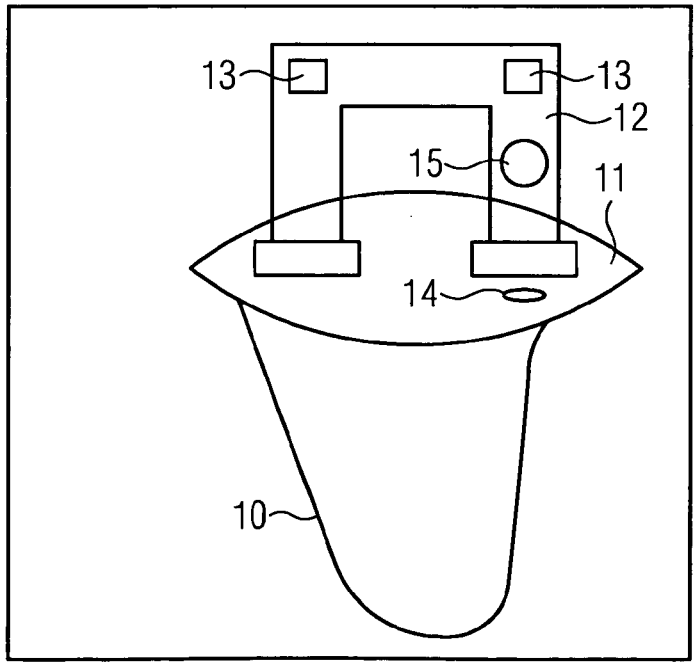
FIG. 3 shows a view of the ITE hearing device in FIG. 2 from an observation angle which is rotated about 90°.

The gripping element, i.e. the tab 12, can be pivoted from a non-operational position into an operational position. The non-operational position, in which the tab 12 is not needed in order to remove the ITE hearing device, corresponds to a position, in which the tab 12 rests in a planar fashion on the faceplate. FIG. 3 shows the operational position of the tab 12. In this position, the hearing device wearer can grip the tab 12 with his/her finger tips in order to remove the hearing device from the ear. By contrast, FIG. 2 shows an intermediate position between the non-operational position and the operational position (cf. double arrow).

In the view of the hearing device in FIG. 3, the shape of the tab 12 can be identified more easily. It is embodied here to be U-shaped and/or triangular. Charging contacts 13 are arranged on the connecting points of two sides in each instance, here on the comers of the tab 12. They are positioned on the lower side of the tab 12, i.e. on the side which faces the faceplate 11 when the tab 12 is in the non-operational position. In this way they are outwardly concealed and protected by the tab 12 in the non-operational position. The contact surfaces of the charging contacts 13 are concealed by the housing and/or faceplate 11. When the non-operational position is reached, they are namely pivoted by the gripping element on the surface of the faceplate 11, so that their contact surfaces are concealed. In this position, an unintentional contacting of the charging contacts 13 with metallic objects cannot result, thereby potentially resulting in an unintentional discharging of the accumulator of the ITE hearing device.

The tab 12 preferably exhibits the contour of a connector so that it can be used as a charging plug of the hearing device and can be plugged into a corresponding socket of a charging device, which is embodied in the manner of a slot for instance. Plugging into the charging socket may also ensure a certain mechanical hold of the hearing device. If the charging device is used simultaneously as a storage box, the charging plug can introduce the necessary hold in the storage box.

In the present example, the ITE hearing device also exhibits an opening 14 in the faceplate. This opening 14 allows the interior space of the hearing device to be ventilated and dried. Since a battery charger, which, in the open state, allows air to be exchanged between the hearing device interior space and the exterior environment, provision is not made in the case of a rechargeable hearing device for an opening 14 of this type to be adequate to guarantee the necessary exchange of air. So that this opening is sealed however when the ITE hearing device is used, a sealing plug 15 is attached to the tab 12. It seals the opening 14 in the non-operational position of the tab 12 in a watertight fashion. The opening 14 can also be used for measurement or programming purposes.

Alternatively, the opening can also be sealed in the operational position, if a lever is arranged at right angles on the tab 12 in the inner chamber of the hearing device for instance, and the sealing plug is fastened to the lever.

The tab 12 is pivotably mounted on the ITE hearing device in accordance with FIG. 2. The movement of the tab 12 and/or of the gripping element can be used to switch the ITE hearing device on and off. An on/off switch 16 is thus connected here to the tab 12 in the vicinity of its pivot bearing. In the present example, a contact arm 17 of the on/off switch 16 is moved and/or pivoted with the tab 12. It is connected to a corresponding counter contact 18 in the operational position of the tab 12. The two contacts 17 and 18 are only no longer connected when the tab 12 is in the non-operational position so that the ITE hearing device is switched off.

The tab 12 can also be connected to a pushbutton 19, which likewise has a contact arm 20 and a counter contact 21. Moving the tab 12, upon which the contact arm 20 is fastened, allows the two contacts 20 and 21 to be connected. In some circumstances, they are also contacted when the operational position is pushed excessively. The tab 12 therefore also represents the control element of the pushbutton 19, by way of which a pulse can be output, in order to select a hearing device program, an amplification stage etc. for instance.

The tab 12 and/or the gripping element thus advantageously have the following multifunctionality. It is used to remove the ITE hearing device from the ear, to seal the opening 14, as a charging plug, as an on/off switch and as a pushbutton. It is thus possible to dispense with numerous elements, which only fulfill one individual function in each instance so that the ITE hearing device can be of a smaller design overall.

According to an alternative embodiment, the gripping element can also be removed from the ITE hearing device. In the removed state, the gripping element is then positioned in the operational position, whereas in the inserted state, it is positioned in the non-operational position. In this example, the charging contacts on the gripping element would be countersunk into the interior of the hearing device housing when in the inserted state. This "countersunk state" of the charging contacts is understood in the present application as "concealing" the charging contacts by means of the housing.

If it is desired, the charging contacts 13 in the non-operational position can also be de-energized. To this end, a similar mechanism can be used as in the case of the on/off switch 16.

According to a further exemplary embodiment, the charging contacts 13 can be arranged on the faceplate and the gripping element and/or the tab 12 conceals the charging contacts 13 in the non-operational position, while they are openly accessible on the faceplate 11 when the tab 12 is in the operational position.

The invention claimed is:

1. An in-the-ear hearing device, comprising:

a housing having a housing surface when the in-the-ear hearing device is being worn, the housing surface points outwards;

an accumulator in the housing;

a gripping element arranged on the housing surface, the gripping element is movable between a non-operational position and an operational position; and a charging contact for charging the accumulator, when the gripping element is in the non-operational position the charging contact is concealed by the gripping element of the housing, when the gripping element is in the operational position the charging contact is not concealed, wherein the charging contact is arranged on the gripping element.

2. The in-the-ear hearing device as claimed in the claim 1, wherein the outwardly pointing housing surface forms part of a faceplate on which the gripping element is also fastened in a moveable fashion.

3. The in-the-ear hearing device as claimed in claim 1, wherein the gripping element is pivotable between the operational position and the non-operational position.

4. The in-the-ear hearing device as claimed in claim 1, wherein in order to change the gripping element between the operational position and the non-operational position, the gripping element is linearly pulled.

5. The in-the-ear hearing device as claimed in claim 1, wherein the gripping element is a tab.

6. The in-the-ear hearing device as claimed in claim 1, wherein the gripping element is coupled to a switch such that the in-the-ear hearing device is switched off in the non-operational position of the gripping element and is switched on in the operational position of the gripping element.

7. The in-the-ear hearing device as claimed in claim 1, wherein the gripping element is coupled to a pushbutton such that a pulse is generated by moving the gripping element.

8. The in-the-ear hearing device as claimed in claim 5, wherein the tab is U-shaped.

9. The in-the-ear hearing device as claimed in claim 5, wherein the tab is triangular.

10. The in-the-ear hearing device as claimed in claim 1, wherein the gripping element is removable.

11. The in-the-ear hearing device as claimed in claim 10, wherein the gripping element in the operational position is in a removed state, and wherein the gripping element in the non-operational position is in an inserted state.

12. The in-the-ear hearing device as claimed in claim 11, wherein the charging contacts are countersunk into an interior of the hearing device housing when in the inserted state.

13. An in-the-ear hearing device, comprising:

a housing having a housing surface when the in-the-ear hearing device is being worn, the housing surface points outwards;

an accumulator in the housing;

a gripping element arranged on the housing surface, the gripping element is movable between a non-operational position and an operational position; and a charging contact for charging the accumulator, when the gripping element is in the non-operational position the charging contact is concealed by the gripping element or the housing, when the gripping element is in the operational position the charging contact is not concealed wherein the housing surface has an opening, which is sealed by a sealing plug attached to the gripping element when the gripping element is in the non-operational position.

14. The in-the-ear hearing device as claimed in claim 13, wherein the opening on the gripping element is used for measurement and/or programming purposes.

15. The in-the-ear hearing device as claimed in claim 13, wherein the gripping element is pivotable between the operational position and the non-operational position.

16. The in-the-ear hearing device as claimed in claim 13, wherein in order to change the gripping element between the operational position and the non-operational position, the gripping element is linearly pulled.

17. The in-the-ear hearing device as claimed in claim 13, wherein the gripping element is a tab.

18. The in-the-ear hearing device as claimed in claim 13, wherein the gripping element is coupled to a switch such that the in-the-ear hearing device is switched off in the non-operational position of the gripping element and is switched on in the operational position of the gripping element.

19. A hearing device system, comprising:

an in-the-ear hearing device, comprising:

a housing having a housing surface when the in-the-ear hearing device is being worn, the housing surface points outwards, an accumulator in the housing, a gripping element arranged on the housing surface, the gripping element is movable between a non-operational position and an operational position, and a charging contact for charging the accumulator, when the gripping element is in the non-operational position the charging contact is concealed by the gripping element or the housing, when the gripping element is in the operational position the charging contact is not concealed, the charging contact which is used as a charging plug is arranged on the gripping element; and a charging device, wherein the charging plug is plugged into a corresponding charging socket in the charging device in order to charge the in-the-ear hearing device, and wherein the outwardly pointing housing surface forms part of a faceplate on which the gripping element is also fastened in a moveable fashion, and wherein the charging contact is arranged on the gripping element.

* * * * *